US006077030A

United States Patent [19]

Fröchte et al.

[11] Patent Number: 6,077,030

[45] Date of Patent: Jun. 20, 2000

[54] ARRANGEMENT FOR THE GATHERED COLLECTION OF SHEETS OF A RECORDING MEDIUM

[76] Inventors: Heinz Fröchte, Beethovenstrasse 6, Zimmern, Germany, D-78658; Ludwig Bantle, Wiesenstrasse 40, Bösingen, Germany, D-78662

[21] Appl. No.: 09/233,926

[22] Filed: Jan. 20, 1999

[30] Foreign Application Priority Data

Mar. 18, 1998 [DE] Germany ..... 198 11 698

[51] Int. Cl.[7] ..... B65H 29/58

[52] U.S. Cl. ..... 414/789.9; 414/790.7; 414/794.8; 414/795; 271/207

[58] Field of Search ..... 414/788.5, 789.9, 414/790.7, 794.8, 795, 797.3, 797.7; 271/207, 209, 177, 189

[56] References Cited

U.S. PATENT DOCUMENTS

| | | | |
|---|---|---|---|
| 3,117,500 | 1/1964 | Donahue et al. | 414/790.7 |
| 3,888,267 | 6/1975 | Gautschi | 414/789.9 |
| 4,618,302 | 10/1986 | Kokubo et al. | 414/789.9 |
| 4,822,018 | 4/1989 | Hain | 271/207 |
| 5,174,561 | 12/1992 | Lebeau | 271/207 |
| 5,735,516 | 4/1998 | Gerlier et al. | 414/789.9 |
| 5,931,635 | 8/1999 | Barthold | 414/797.3 |

FOREIGN PATENT DOCUMENTS

| | | | |
|---|---|---|---|
| 236561 | 9/1987 | European Pat. Off. | 271/207 |
| 281790 | 9/1988 | European Pat. Off. | 271/207 |
| 19515506A1 | 4/1995 | Germany . | |
| 57-85760 | 5/1982 | Japan | 271/207 |
| 58-22256 | 2/1983 | Japan | 271/207 |
| 62-36267 | 2/1987 | Japan | 271/207 |
| 3-246694 | 11/1991 | Japan | 271/207 |

*Primary Examiner*—Douglas Hess
*Attorney, Agent, or Firm*—Higgs, Fletcher & Mack LLP; Bernard L. Kleinke

[57] ABSTRACT

An arrangement is described for the gathered collection of sheets of a recording medium, which are output by a recording device. The sheets are collected sequentially on the periphery of a drum. In the periphery of the drum is provided a depression in which drivable transport rollers are disposed. The transport rollers cooperate with pressing rollers which can be swiveled against the transport rollers. The transport rollers and the pressing rollers serve, on the one hand, for clamping the gathered sheets against the drum and, on the other hand, for ejecting the gathered bundle.

14 Claims, 7 Drawing Sheets

ARRANGEMENT FOR THE GATHERED COLLECTION OF SHEETS OF A RECORDING MEDIUM

CROSS-REFERENCE TO RELATED APPLICATIONS

This application is based on co-pending priority German Patent Application No. 198 11 698.5.

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Technical Field

The invention relates to an apparatus for the gathered collection of sheets of a recording medium according to the preamble of claim 1.

2. Background Art

In many devices of office and data technology it is desired to collect the sheets, provided with recordings and output sequentially by a recording device, for example a printer or copier, and to make them available in gathered form. An application example are the so-called bank terminals at which gathered account statements are output in gathered form.

It is known to deposit the sequentially output sheets on a stack which can subsequently be removed. Such devices have a considerable space requirement which is of disadvantage for many applications.

It is further known to collect the sequentially output sheets on the periphery of a drum and to output the bundle of sheets collected on the drum. To this end, the drum comprises a circumference which is at least equal to the length of the sheets such that the sheets can be wound on the periphery of the drum. With each rotation of the drum, a sheet is taken up and placed onto the bundle already collected on the drum. These arrangements are extremely space-saving, in particular since no stacking bin for stacking the sheets is required.

In these known arrangements grippers are disposed on the periphery of the drum which take hold of the advancing edge of the sheets and press it against the drum. The grippers are preferably opened and closed via a mechanical control. To output the gathered bundle by the drum, additional transporting mechanisms are required.

SUMMARY OF THE INVENTION

The invention is based on the task of creating an arrangement for the gathered collection of sheets of a recording medium, which is simple of construction and flexible in use.

In the case of the arrangement according to the invention, the sheets output by a recording apparatus are collected in gathered form on the periphery of a rotating drum. The drum accepts the sheets output by the recording device, holds these at their advancing edge and pulls the sheets off the recording device and winds them onto the periphery of the drum. A substantial idea of the invention comprises providing in the periphery of the drum a depression, extending in the longitudinal direction, in which transport rollers are disposed which can be driven parallel to the drum axis by means of a transport shaft. The transport rollers have a twofold function. For one, they accept the sheets coming from the recording device, hold them at their advancing edge and press these sheets against the drum. To this extend, the transport rollers fulfill the function of the conventional grippers in order to hold the gathered sheets on the drum and to pull them off the recording device. For another, the transport rollers serve to output the gathered bundle of sheets from the drum. Since the transport rollers effect the holding of the sheets against the drum as well as also the output of the gathered sheets from the drum, an extremely simple, cost-effective and space-saving structure of the arrangement is obtained.

In addition, the arrangement is extremely flexible in terms of operating manner, which yields additional function capabilities which cannot be realized at all in the case of conventional arrangements or only with considerable expenditures.

For example, by means of the transport rollers the gathered bundle of sheets can initially be only shifted forward over a portion of the length of the sheets from the drum in order to offer the user the beginning of the bundle. If the user takes hold of the beginning of the bundle in order to remove it, the transport rollers shift the bundle completely from the drum toward the ejection. However, if the bundle offered is not taken hold of and no tension is exerted onto this bundle, the direction of rotation of the transport rollers is reversed and the bundle is again pushed back onto the drum. This ensures that the bundle which had been offered but not removed, for example of account statements, is not removed by unauthorized persons.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

In the following the invention will be explained in further detail in conjunction with an embodiment example depicted in the drawing. Therein show.

BEST MODE FOR CARRYING OUT THE INVENTION

Figure 1:
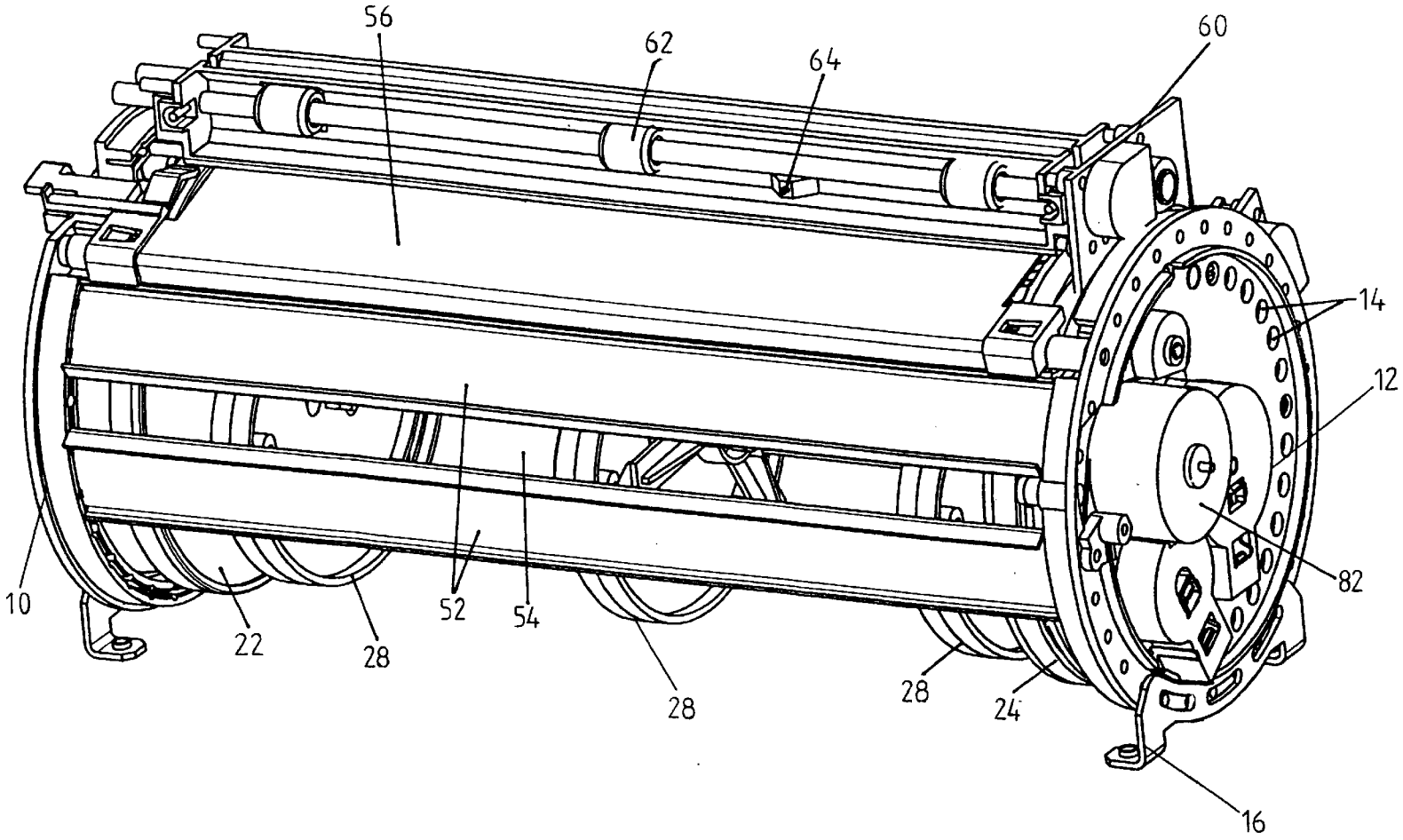
FIG. 1 a perspective view of the arrangement.

FIG. 1 shows the complete arrangement such as can be attached to a recording device, for example a printer or a copier. The arrangement comprises a left side wall 10 and a right side wall 12, which have substantially the form of circular disks. On the periphery of the side walls 10 and 12 a crown of threaded bores 14 is provided in a given angular distribution. By means of the threaded bores 14 on the side walls 10 and 12 bolt-on angles 16 are secured which serve for mounting the arrangement on the sheet output of the recording device. The angular distribution of the threaded bores 14 permits a high degree of freedom in the angular position of the arrangement with respect to the recording device, and, thus, an optimum adaptation capability of the arrangement to the sheet output of the recording device.

Between side walls 10 and 12 of the arrangement is supported rotatably on an axle 18 a drum 20 which is depicted in FIGS. 2 to 5. The drum 20 comprises at its two axial end sides drum walls 22 and 24 which have the form of circular disks with the diameter of the drum walls 22 and 24 being somewhat smaller than the diameter of the side walls 10 and 12. The drum walls 22 and 24 are rigidly connected via axially parallel stays 26. Between the drum walls 22 and 24 three cam plates 28 are supported at axial intervals on the stays 26, which cam plates are connected via the stays 26 rotationally tight with the drum walls 22 and 24.

The cam plates 28 have substantially also the form of circular disks with their radius, corresponding to the thickness of the bundle of sheets to be collected, being smaller than the radius of the drum walls 22 and 24. In an angular sector the cam plates 28 have a radial depression 30 in their periphery which, in axial top view, has an approximately S-form contour. The S-form of the depression 30 can be seen most clearly in FIGS. 6 and 7. In the circumferential direction (in FIGS. 6 and 7 in the clockwise direction) the depression 30 initially extends on its run-in side with a gentle curvature and decreasing radius of curvature toward the inside and subsequently turns again outwardly and then changes at its exit side substantially radially into the periphery of the cam plates 28.

In the region of the depressions 30 transport rollers 32 are disposed, which are supported torsion-tight on a common transport shaft 34 parallel to the axle 18 of drum 20 and which can be driven by means of this transport shaft 34. The transport shaft 34 is rotatably supported In the drum walls 22 and 24. The disposition of the transport shaft 34 and the diameter of the transport rollers 32 are matched such that the transport rollers 32 rest in the depressions 30 within the circular circumferentiall contour of the cam plates 28. As is shown in particular in FIG. 6, between the periphery of the transport rollers 32 and the circumferentiall contour of the depression 30 a passage gap remains free which corresponds substantially to the thickness of the maximum bundle of sheets to be collected.

Furthermore, associated with the cam plates 28 and the transport rollers 32 are pressing rollers 36. The pressing rollers 36 are supported on a pressing shaft 38 which extends axially parallel to the axle 18 of the drum 20 and penetrates openings of the cam plates 28. The right end of the pressing shaft 38 terminates in front of the right drum wall 24, while the left end of the pressing shaft 38 extends through an opening of the left drum wall 22. Both ends of the pressing shaft 38 are each fulcrumed into the free end of a rocking lever 40, which is situated swiveling on a lever shaft 42. The lever shaft 42 is pivoted in the drum walls 22 and 24 and is drivable. The driving of the lever shaft 42 is transmitted via toothed gears and toothed belts 44 onto the pressing shaft 38 and, thus, onto the pressing rollers 36. The pressing rollers 36 are each disposed pairwise in both sides of the cam plates 28 and are disposed substantially within the contour of the cam plates 28. Via the rocking lever 40 the pressing rollers 36 situated on the pressing shaft 38 are slewed between an open position swiveled radially inwardly, shown in FIGS. 2 and 6, and a clamping position swiveled radially outwardly, shown in FIGS. 3 and 7. In the open position the periphery of the pressing rollers 36 is disposed in the region of the depression 30 within the contour of the cam plate 28, while in the clamping position the pressing rollers 36 are in contact on the transport rollers 32 on both sides of the cam plate 28. Leg springs 46 supported on the lever shaft 42 press the rocking lever 40 into the clamping position such that the pressing rollers 36 under the effect of the leg springs 46 are in contact on the transport rollers 32. In order to swivel the pressing rollers 36 against the force of the leg springs 46 into the open position, the left end of the pressing shaft 38 penetrating the left drum wall 22 is guided in a slotted link 48, radially rising in the circumferential direction, of a crank wheel 50. The crank wheel 50 is supported free rotatable coaxially to axle 18 on the outside of the left drum wall 22.

As shown in FIG. 1, on the periphery of the side walls 10 and 12 of the arrangement two run-in guidances 52 are disposed, which extend axially parallel over the entire width of the arrangement between the side walls 10 and 12. Between the run-in guidances 52 is formed a run-in gap 54 through which the sheets coming from the recording device are supplied to the arrangement. Through the disposition of the bolt-on angles 16 on the crown of the threaded bores 14 the run-in gap 54 can be adapted geometrically to the sheet ejection of the recording device.

In the direction of rotation of drum 20 the run-in guidances 52 are adjoined in the circumferential direction by a stop 56 which is implemented as a flat sheet and disposed on the outer periphery of the side walls 10 and 12 and which extends between these. With the edge facing the run-in guidances 52, the stop 56 is supported swivelably outside on the periphery of the side walls 10 and 12. With the edge facing away from the run-in guidances 52, the stop 56 engages between the side walls 10 and 12 as well as the drum walls 22 and 24 and, under the effect of a spring 58, is in contact on the outer periphery of the cam plates 28.

Figure 7:
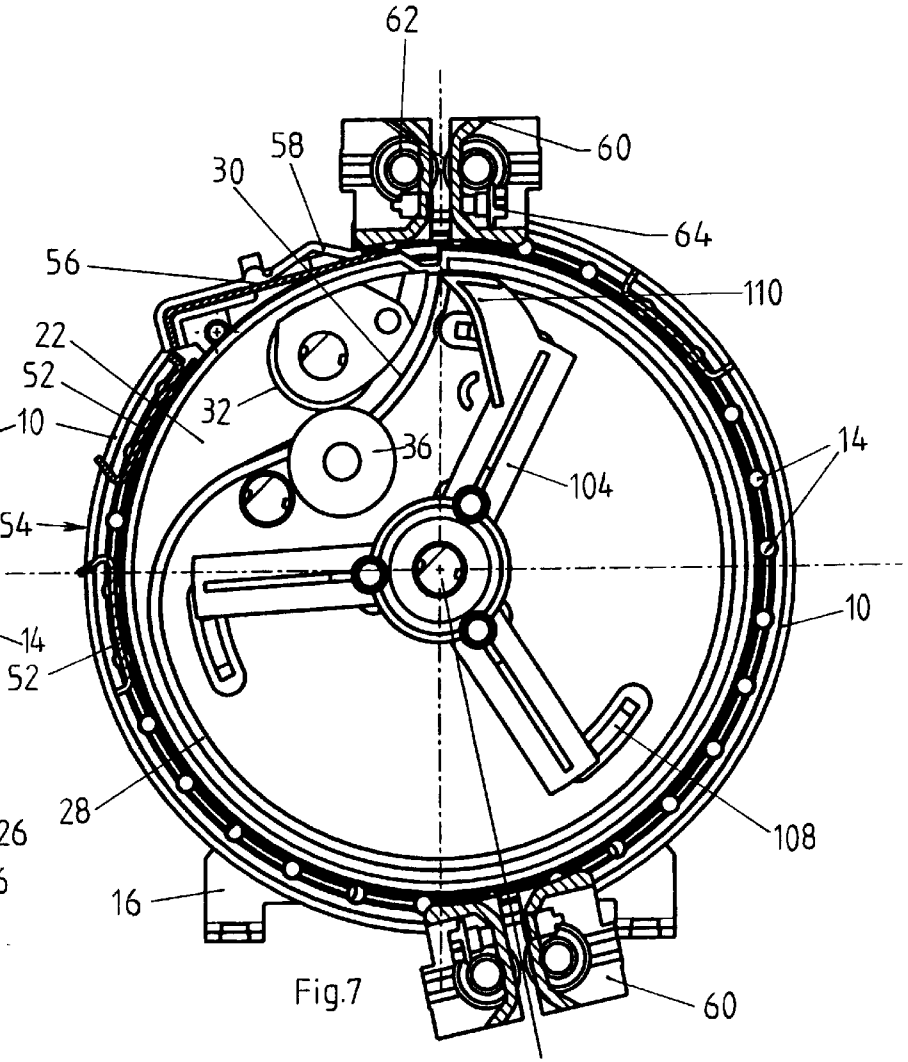

Further, on the outer periphery of side walls 10 and 12 is disposed an ejection unit 60 whose angular position with respect to the run-in gap 54 can be freely selected in an angle of circumferential angular sector of nearly 180° since the ejection unit 60 is also secured on the crown of the threaded bores 14. The two extreme angular positions of the ejection unit 60 are depicted in FIG. 7. Through the freely selectable arrangement of the ejection unit 60 the output direction for the collected bundles of sheets can also be adapted to the installation condition of the arrangement. The ejection unit 60 comprises drivable ejection rollers 62. A light [photoelectric] barrier 64 serves for checking and controlling the ejection unit.

Figure 2:
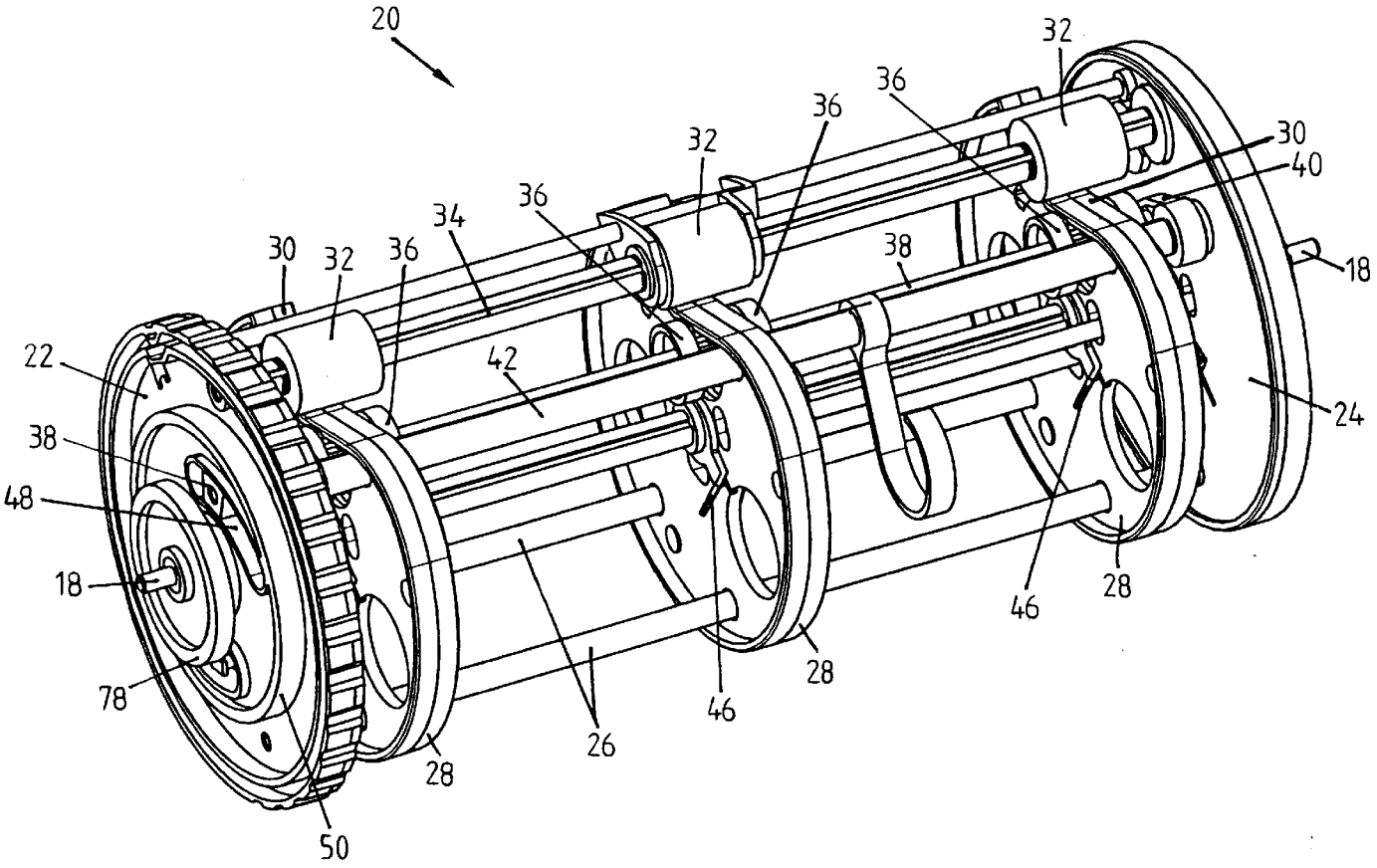
FIG. 2 a perspective view of the drum of the arrangement from the left with the transport rollers opened, FIG. 3 a view of the drum corresponding to FIG. 2 with closed transport rollers, FIG. 4 a perspective view of the drum from the right with nonactuated sheet indicator, FIG. 5 a representation corresponding to FIG. 4 with actuated sheet indicator, FIG. 6 a cross section through the arrangement in the acquisition position, FIG. 7 a cross section corresponding to FIG. 6 in the ejection position, FIG. 8 a perspective view of the gearing configuration on the inside of the left side wall of the arrangement, and FIG. 9 a perspective view of the hearing configuration on the inside of the right side wall of the arrangement.
Figure 3:
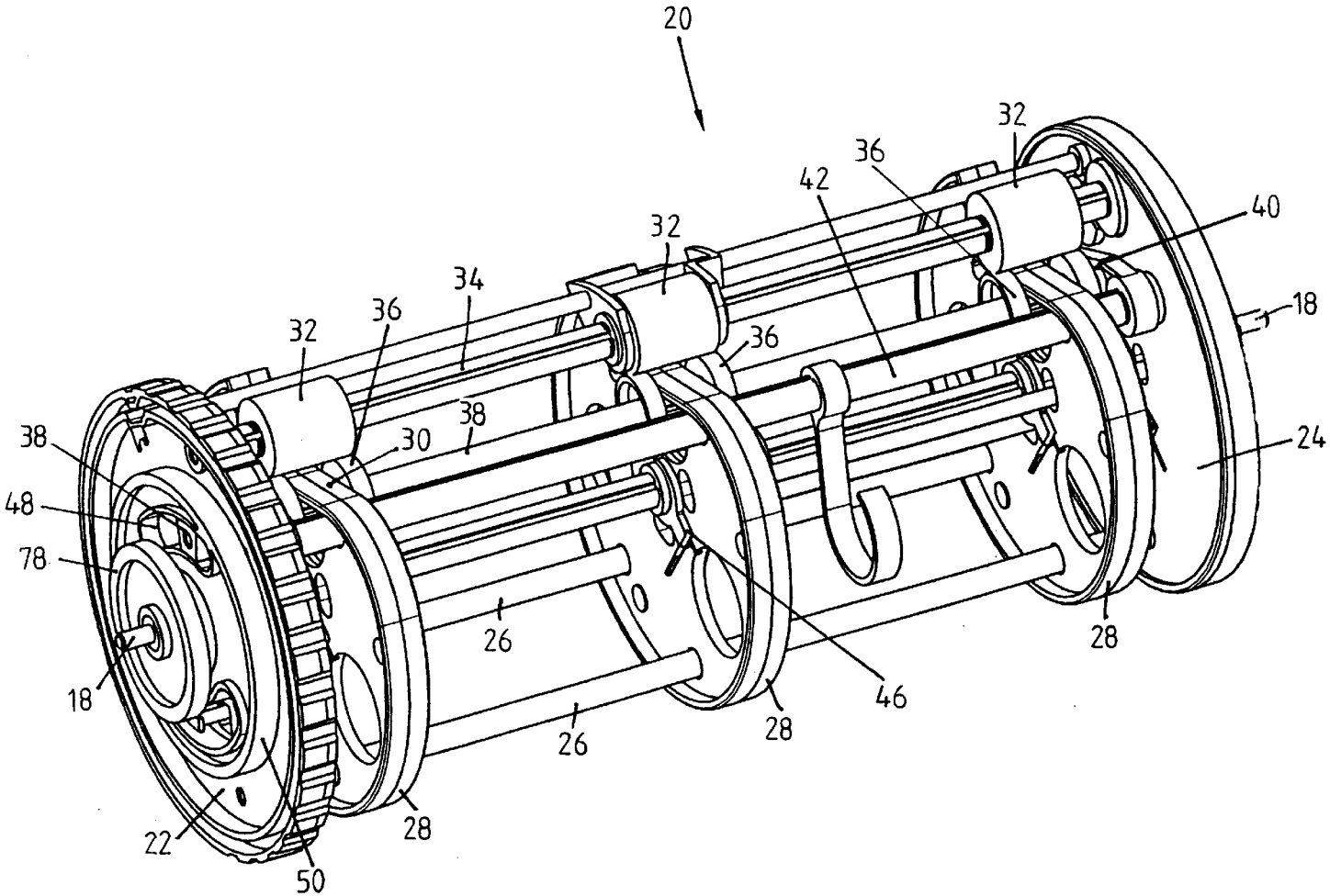
Figure 8:
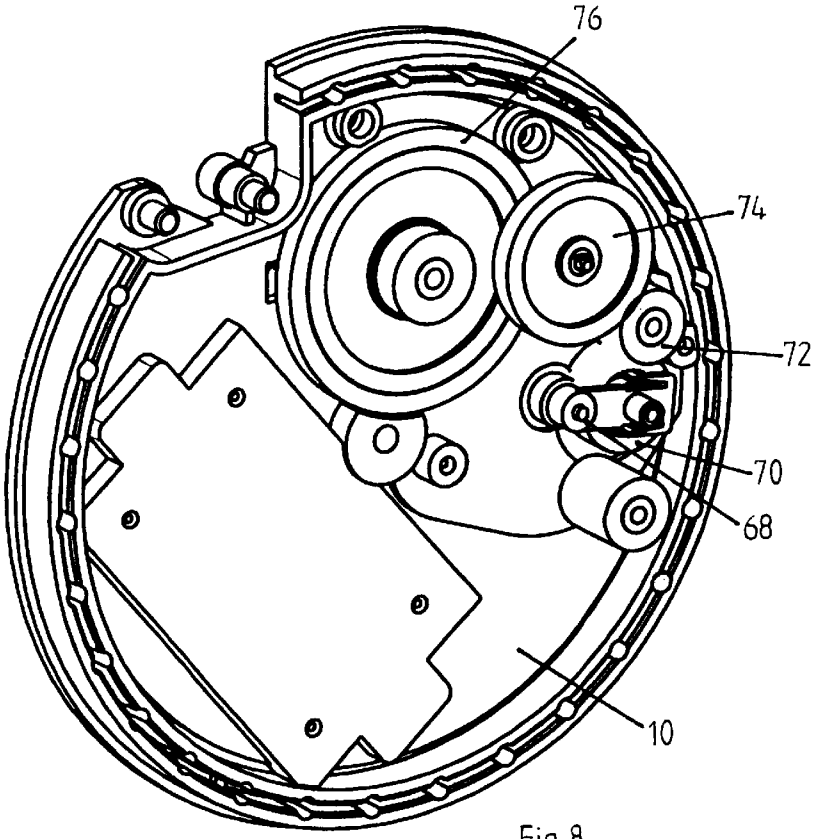

On the left side of the arrangement is disposed a driving mechanism whose parts supported inside on the left side wall 10 are shown in FIG. 8. On the outside on the left sidewall 10 is disposed a first stepping motor 66 which is drivable in both directions under control. A driven pinion 68 of the stepping motor 66 drives a swivelably supported change-over toothed wheel 70. If the stepping motor 66 is driven such that the driven pinion 68 in FIG. 8 rotates in the counterclockwise direction, the drum 20 is driven. For this purpose the change-over toothed wheel 70 is swiveled into engagement with a toothed wheel 72 which drives via gearing wheels 74 and 76 a toothed wheel 78 which is supported coaxially with axle 18 on the drum 20, as is shown in FIG. 2.

If the stepping motor 66 is changed over into the opposite direction of rotation, the driven pinion 68 in FIG. 8 rotates in the clockwise direction. The change-over toothed wheel 70 is swiveled into engagement with a toothed wheel 70 is swiveled into engagement with a toothed wheel 80 which, in turn, engages an outer toothing of the crank wheel 50. Thereby the crank wheel 50 is rotated such that the pressing shaft 38 guided in the slotted link 48 of the crank wheel 50 migrates radially inwardly and the pressing rollers 36 are raised off the transport rollers 32 and brought into the open position.

Figure 4:
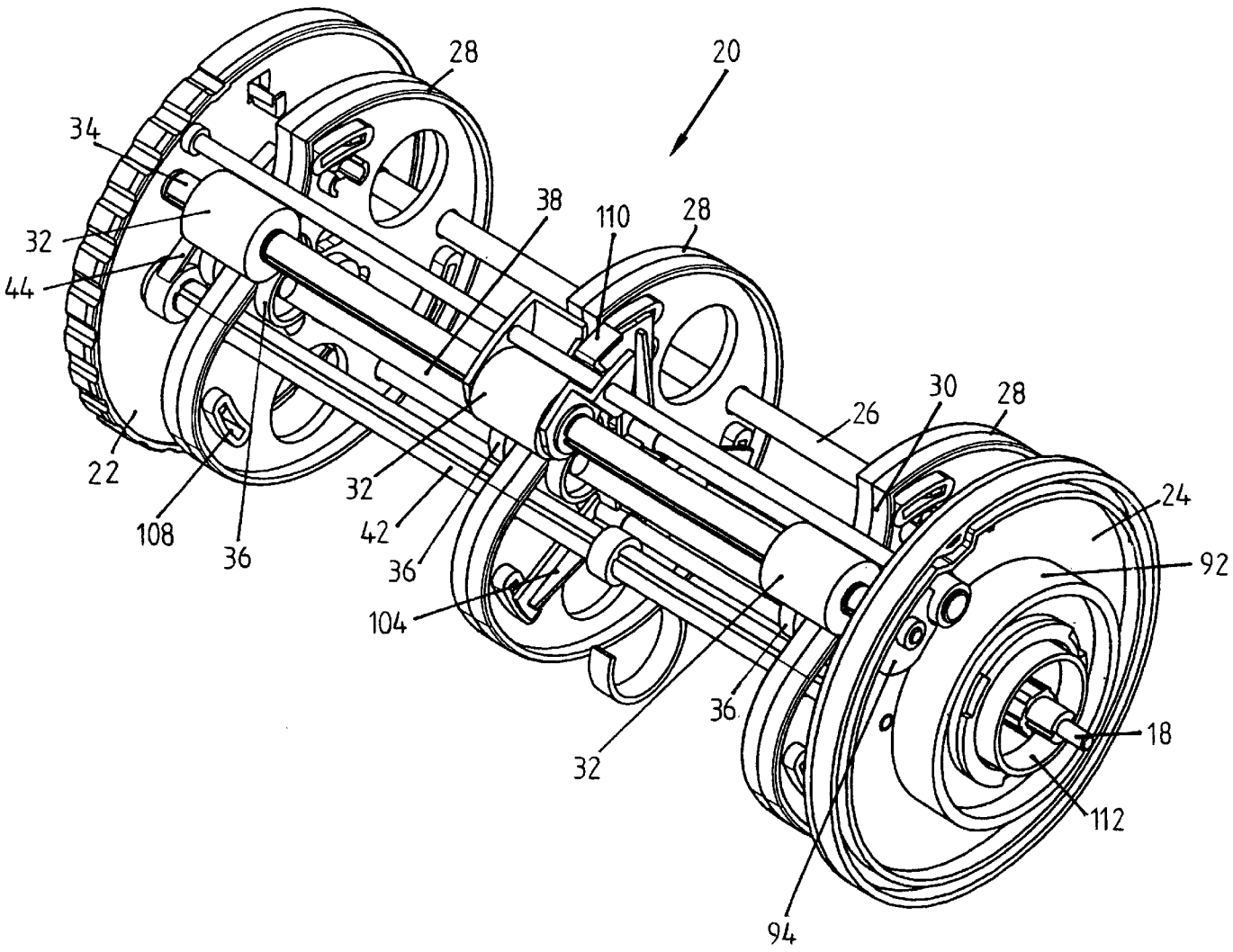
Figure 5:
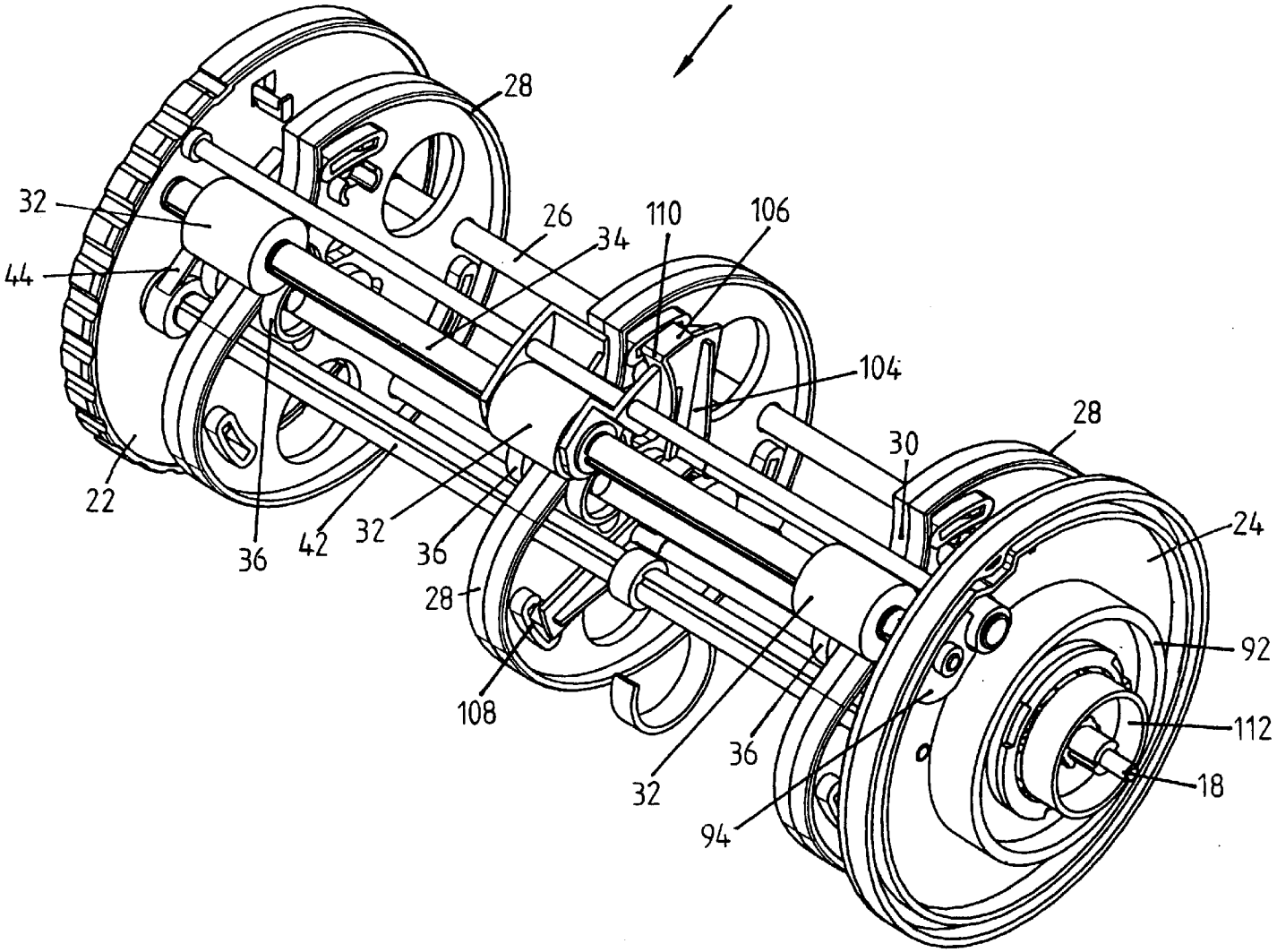
Figure 9:
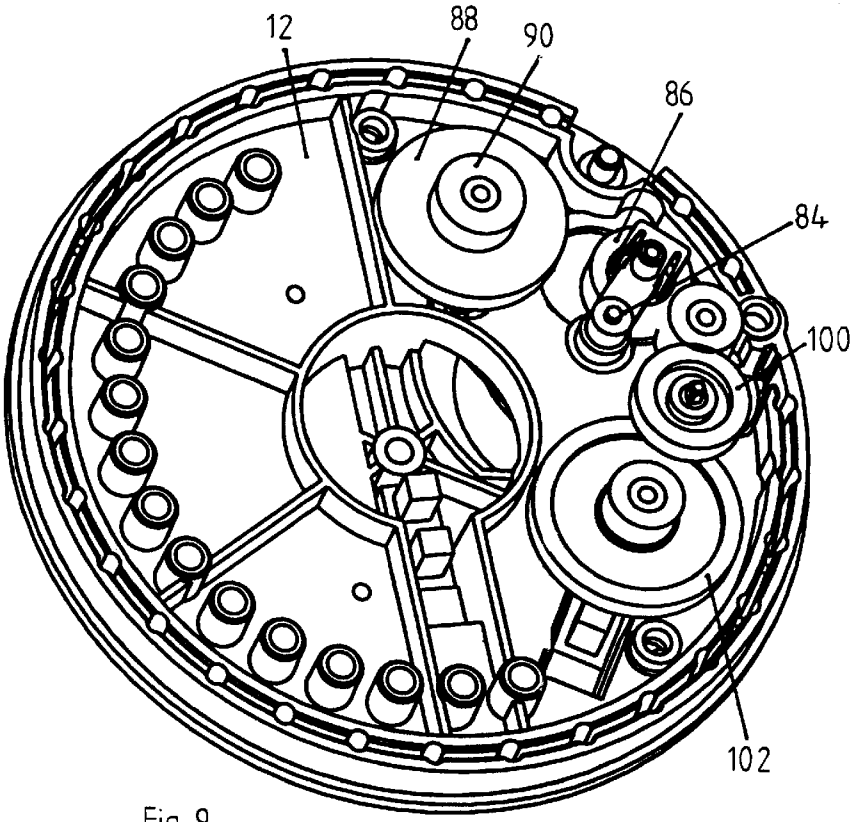

FIG. 9 shows a driving mechanism which is disposed inside on the right side wall of the arrangement. Outside on the right side wall 12 is disposed a second stepping motor 82 which can be changed over with respect to this direction of rotation. A driven pinion 84 of the stepping motor 82 drives a change-over toothed wheel 86 which is swivelably supported. If the driven pinion 84 in FIG. 9 is driven in the counterclockwise direction, the change-over toothed wheel 86 engages a toothed wheel 88 which drives via a pinion 90 a crown gear 92 which is supported freely rotatably coaxially with axle 18 on the right drum wall 24, as is shown in FIG. 4. The crown gear 92 meshes with a driving mechanism toothed wheel 94, which is supported on the transport shaft 34 and drives the transport rolls 32. At this rotation of direction of the second stepping motor 82 and this position of the changeover toothed wheel 86 the crown gear 92 is driven such that the driving toothed wheel 94 drives the transport rollers 32 in the direction toward the ejection.

If the stepping motor 82 is changed over so that the driven pinion 84 rotates in the clockwise direction, the change-over toothed wheel 86 engages a toothed wheel 98 which, via two further gearing wheels 100 and 102 drives the crown gear 92 in the opposite direction. Thereby the transport rollers 32 are driven via the driving toothed wheel 94 in the direction of retraction. The crown gear 92 is the intermediary between the engagement of the gearing supported on the stationary right drum wall 24 and the driving toothed wheel 94 rotating with this drum wall 24.

Figure 6:
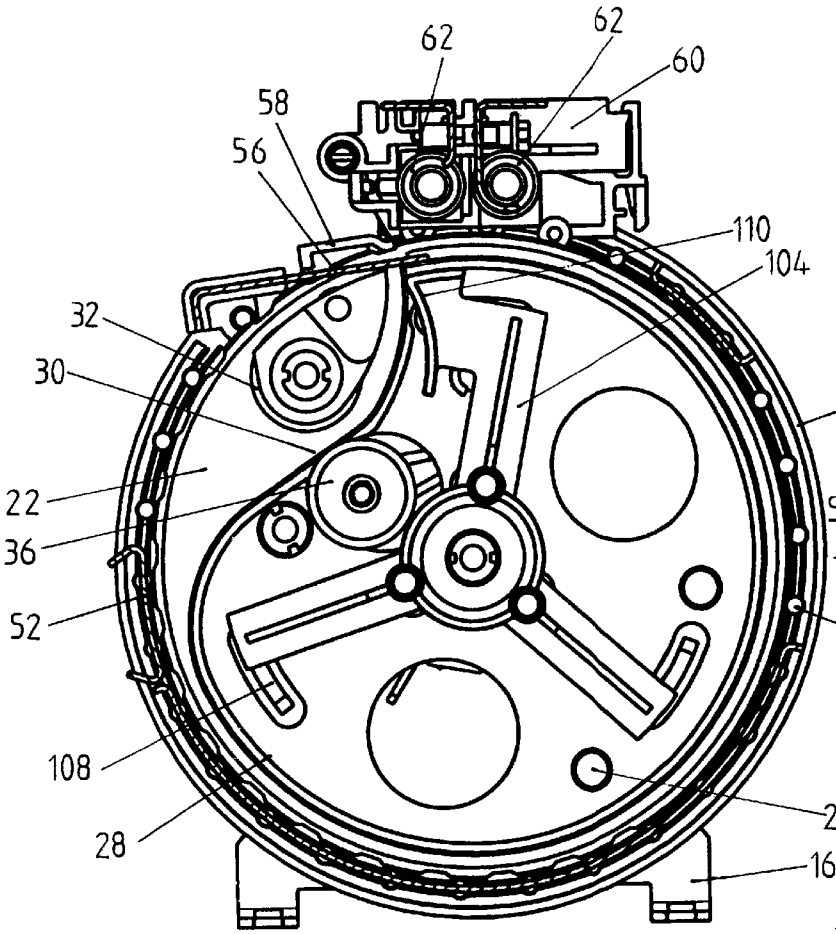

The arrangement operates in the following way:

In order to acquire a sheet coming from the recording device and supplied through the run-in gap 54, the drum 20 is rotated by means of the first stepping motor 66 into the position which is shown in FIG. 6. The run-in side of the depression 30 is located behind the run-in gap 54. The stop 56 rests on the exit side of depression 30 and closes it. The stepping motor 66 is now changed over such that it drives the crank wheel 50 and via the slotted link 48 swivels the pressing rollers 36 against the force of the leg springs 46 into the open position such that the arrangement assumes the position shown in FIG. 6. The sheet supplied via the run-in gap 54 arrives with its front edge in the depression 30 and is guided in it between the transport rollers 32 and the outer periphery of the cam plates 28 until the front edge of the sheet comes into contact on stop 56. Now, the stepping motor 66 is again changed over into the opposite direction of rotation. The crank wheel 50 is released such that the pressing rollers 36 are pressed through the leg springs 46 against the transport rollers 32, as is shown in FIG. 7. The sheet is thereby clamped between the transport rollers 32 and the pressing rollers 36 through the force of the leg springs 46. The stepping motor 66 drives the drum 20 in the clockwise direction (FIGS. 6 and 7), and the sheet clamped between the transport rollers 32 and the pressing rollers 36 is pulled out of the recording device and rests in contact on the periphery of the drum 20. The spring-cushioned stop 56 acts therein as a holding-down device which holds the sheet in contact on the periphery of the cam plates 28.

The cam plates 28 are dimensioned such that their circumferences are at least equal to the length of the sheet so that the sheet can be in contact over its entire length on the periphery of the cam plates 28 until the drum has reached again the acquisition position shown in FIG. 6. In this position the stepping motor 66 is again changed over in order to move the pressing rollers 36 into the open position so that the next sheet coming from the recording device can be supplied and be aligned on the stop 56 and subsequently be stacked onto the preceding sheet. The process is cyclically repeated in this way until all sheets coming from the recording device are collected and gathered on the periphery of drum 20. Drum 20 is subsequently rotated under the control of stepping motor 66 into the ejection position which is shown in FIG. 7. In this ejection position the exit side of depression 30 is radially aligned with the ejection unit 60. When this ejection position is reached, the transport rollers 32 and the pressing rollers 36 are driven by means of the second stepping motor 82 in order to transport the collected bundle into the ejection rollers 62 of the ejection unit 60, which acquires the bundle and transports it further.

The possibility exists of controlling the stepping motor 82, for example via the light barrier 64, such that the bundle of sheets initially is only partially guided beyond the ejection unit 60 while the rear portion of the bundle remains clamped between the transport rollers 32 and the pressing rollers 36. In this position the bundle is offered to the user for removal. If the user pulls on the bundle, the stepping motor 82 is again started and the transport rollers 32 and the pressing rollers 36 push the bundle completely out of the arrangement. If, however, the bundle is not pulled out in the position in which it is offered, the stepping motor 82 switches over so that the transport rollers 32 and the pressing rollers 36 are driven in the direction of retraction and transport the bundle from the ejection unit 60 again back onto drum 20.

The transport rollers 32 and the pressing rollers 36 can preferably also be driven by means of the second stepping motor 82, while the drum 20 is rotated by the first stepping motor 66. Via the toothed wheel gearing the circumferential speed of the transport rollers 32 and of the drum 20 are therein matched so that no tension effect is exerted onto the sheet.

It is readily evident that the pressing rollers 36 do not absolutely need to be driven. It may also be sufficient to drive only the transport rollers 32 and allow the pressing rollers 36 to run free.

The arrangement preferably comprises a sheet indicator which signals that one or several sheets are present on the drum 20. For this purpose, a trihedral part 104 is provided resting spring-cushioned in contact on the central cam plate 28, which trihedral part 104 is supported freely rotatable on axle 18. The free ends of the limbs of the trihedral part 104 with oblique run-up ramps 106 engage guidance slots 108 of cam plate 28. On one limb of the trihedral 104 a sheet sensor 110 is formed on which engages the depression 30 in the region of the exit side. The trihedral 104 is connected via a coaxial lift tube with a switching cylinder 112, which is disposed on the outside of the right drum wall 24. The switching cylinder 112 cooperates with a light barrier 64. If no sheet is present in the depression 30 between the transport rollers 32 and the pressing rollers 36, the sheet sensor 110 engages the depression 30, which is brought about by means of the spring and the run-up ramps 106 acting onto the trihedral part 104. This position is shown in FIG. 4. In this position the trihedral 104 can dip axially into the guidance slots 108 so that the switching cylinder 112 is axially retracted and enables the light barrier 64. The light barrier 64 signals that no sheet is present on the drum.

If a sheet is supplied between the transport rollers 32 and the pressing rollers 36, the advancing edge of this sheet swivels the sheet sensor 110 from the depression 30 into the contour of the cam plate 28. The trihedral 104 is thereby rotated from the position shown in FIG. 4 in the clockwise direction into the position shown in FIG. 5. The run-up ramps 106 run up in the guidance slots 108 and lift the trihedral 104 against the spring force axially off the cam plate 28. The switching cylinder 112 is thereby axially advanced and actuates the light barrier 64. This signals the presence of a sheet.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. Arrangement for collecting sheets of a recording medium, comprising:

a drum for receiving and collecting the sheets on a sheet engageable portion at the periphery thereof;

clamping means for clamping the front edge of the sheets against the sheet engageable portion, the clamping means including at least one transport roller means disposed axially parallel with respect to the drum for engaging a depression in said sheet engageable portion and being drivable by and rotating together with the drum so that the supplied sheets are collected and clamped by said transport roller means on said sheet engageable portion and wherein the collected sheets are ejected from the drum by said transport roller means.

2. Arrangement as claimed in claim 1, further including pressing roller means for cooperating with said transport roller means to move between a clamping position resting in contact on said transport roller means and an open position spaced apart from said transport roller means.

3. Arrangement as claimed in claim 2 wherein said pressing roller means includes pressing rollers supported on a pressing shaft swivelably supported on the drum walls and passing through openings of the cam plates.

4. Arrangement as claimed in claim 3, wherein the pressing shaft of the pressing rollers is swiveled by a crank wheel disposed on a drum wall of said drum.

5. Arrangement as claimed in claim 1 wherein said drum includes on its axial ends circular disk-form drum walls, cam plates being disposed between said drum walls, the depression being disposed in the periphery of the cam plates.

6. Arrangement as claimed in claim 5, wherein said transport roller means comprise transport rollers supported on a transport shaft said shaft being supported in the drum walls.

7. Arrangement as claimed in claim 6, wherein the transport rollers are disposed in said depression completely within one of the circular circumferential contour of the drum and the cam plates.

8. Arrangement as claimed in claim 1, wherein the drum is supported in side walls on which a stop is connected so that the sheets supplied to the transport rollers are aligned with their front edge.

9. Arrangement as claimed in claim 8, further including side walls having angularly adjustable securing means so that the angular distance between the sheet supply relative to said drum and said securing means can be adapted to the installation conditions of the arrangement.

10. Arrangement as claimed in claim 1, further including an ejection unit disposed axially parallel to said drum on its periphery.

11. Arrangement as claimed in claim 10, further including side walls and a sheet supply, wherein said ejection unit is adjustably disposed on the side walls at an angular distance relative to the sheet supply.

12. Arrangement as claimed in claim 1, further including stepping motors, wherein said drum and said transport roller means are driven each under the control of the stepping motors.

13. Arrangement as claimed in claim 12, further including crank wheel pressing rollers, and a spring, wherein at least one of said stepping motors is driven in the direction of rotation of said drum and drives the crank wheel in the opposite direction of rotation in order to swivel the pressing rollers against the force of the spring away from the transport rollers.

14. Arrangement as claimed in claim 12, wherein one of the stepping motors drives transport rollers in an ejection direction or in a direction of retraction.

* * * * *